US008428290B2

(12) United States Patent
Cheng

(10) Patent No.: US 8,428,290 B2
(45) Date of Patent: Apr. 23, 2013

(54) INPUT-PANEL-EQUIPPED PORTABLE SPEAKER DEVICE

(75) Inventor: Sue Cheng, Chiayi County (TW)

(73) Assignee: Mipro Electronics Co., Ltd., Chiayi (TW)

( * ) Notice: Subject to any disclaimer, the term of this patent is extended or adjusted under 35 U.S.C. 154(b) by 132 days.

(21) Appl. No.: 13/161,865

(22) Filed: Jun. 16, 2011

(65) Prior Publication Data

US 2012/0321119 A1 Dec. 20, 2012

(51) Int. Cl.
*H04R 25/00* (2006.01)

(52) U.S. Cl.
USPC ..... 381/386; 381/395; D14/214; 181/199

(58) Field of Classification Search ..... 381/345, 381/384, 386, 394, 395, 388, 300, 87; 181/199; D14/214, 168
See application file for complete search history.

(56) References Cited

U.S. PATENT DOCUMENTS 3,612,783 A * 10/1971 Schneider ..... 381/404
3,757,890 A * 9/1973 Dunning ..... 381/351
D306,211 S * 2/1990 Maruyama ..... D26/38
5,734,131 A * 3/1998 Sakamoto ..... 181/141
5,748,753 A * 5/1998 Carver ..... 381/96
6,130,954 A * 10/2000 Carver ..... 381/398
6,418,231 B1 * 7/2002 Carver ..... 381/395
7,388,963 B2 * 6/2008 Han et al. ..... 381/397
7,653,208 B2 * 1/2010 Guenther ..... 381/386
8,014,554 B2 * 9/2011 Xu et al. ..... 381/386
D653,238 S * 1/2012 Cheng ..... D14/214
8,235,552 B1 * 8/2012 Tsuge ..... 362/253
2003/0228027 A1 * 12/2003 Czerwinski ..... 381/342

* cited by examiner

*Primary Examiner* — Fan Tsang
*Assistant Examiner* — Phylesha Dabney
(74) *Attorney, Agent, or Firm* — Dickstein Shapiro, LLP.

(57) ABSTRACT

An input-panel-equipped portable speaker device includes a cabinet shell body configured to enclose an accommodation chamber in a longitudinal direction, and having left and right mounting walls opposite to each other in a transverse direction. The left mounting wall has an inner peripheral region defining a fitting opening. The right mounting wall has a positioning groove. An input panel is connected with an amplifier circuit board, and is disposed to cover the fitting opening. When a right board edge of the circuit board is brought to be fitted in the positioning groove, an outer peripheral region of the panel is brought to abut against the inner peripheral region so as to enable an air-tight engagement therebetween.

3 Claims, 4 Drawing Sheets

INPUT-PANEL-EQUIPPED PORTABLE SPEAKER DEVICE

BACKGROUND OF THE INVENTION

1. Field of the Invention

This invention relates to a portable speaker device, more particularly to an input-panel-equipped portable speaker device with a speaker driver mounted on a front tubular end of a cabinet shell body.

2. Description of the Related Art

Referring to FIG. 1, a conventional portable loudspeaker 1 is shown to include a cabinet shell body 11, and a speaker driver 12 and an input panel 13 respectively disposed at a front end and a side wall of the cabinet shell body 11. The loudspeaker 1 may have a microphone plug input in the input panel 13 for connection to a microphone so as to produce an amplified sound output. Generally, in assembling the loudspeaker 1, an amplifier circuit board (not shown) is fastened within the cabinet shell body 11 by means of screws, and the input panel 13 is fastened to the side wall by means of screws 14. Thus, the assembly of the loudspeaker 1 is troublesome, and the screws 14 exposed on the outside may adversely affect the outer appearance of the loudspeaker 1.

SUMMARY OF THE INVENTION

An object of the present invention is to provide an input-panel-equipped portable speaker device which is easy to assembly and which has screw fasteners concealed without affecting the outer appearance of the device.

According to this invention, the input-panel-equipped portable speaker device includes a cabinet shell body configured to enclose an accommodation chamber which extends forwardly and along a centerline in a longitudinal direction to terminate at a front tubular end. The cabinet shell body has left and right mounting walls which extend rearwardly from the front tubular end, and which are spaced apart from each other in a direction transverse to the longitudinal direction. The left mounting wall has an inner peripheral region defining a fitting opening to communicate with the accommodation chamber. The right mounting wall has a positioning groove disposed on an inner wall surface thereof and extending in the longitudinal direction. A speaker driver has a poleplate portion and a basket frame portion configured to be fittingly mounted in the front tubular end so as to permit the poleplate portion to extend into the accommodation chamber along the centerline. An input panel is configured to cover the fitting opening, and has an outer major surface on which an input unit is mounted for inputting an audio signal, and an inner major surface which is opposite to the outer major surface in the transverse direction, and which has an outer peripheral region. An amplifier circuit board has a right board edge configured to be fitted in the positioning groove, and a left board edge mounted on the inner major surface such that, when the right board edge is fitted in the positioning groove, the outer peripheral region is brought to abut against the inner peripheral region through the entire length thereof so as to enable an air-tight engagement therebetween.

Further, the input panel has front and rear fastened frame segments which are spaced apart from each other in the longitudinal direction, and which extend rightwardly from the inner major surface. The cabinet shell body has front and rear positioning lugs which extend from the inner peripheral region in the transverse direction. The speaker device further comprising front and rear fasteners configured to threadedly fasten the front and rear positioning lugs, respectively, to the front and rear fastened frame segments in the longitudinal direction.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
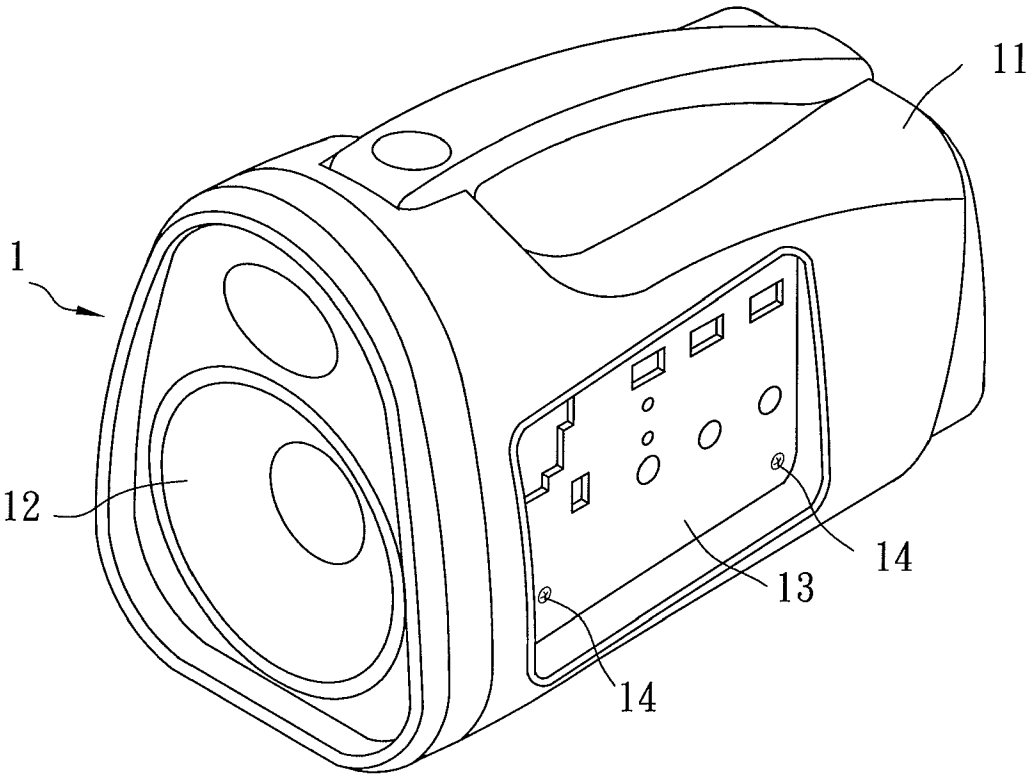
FIG. 1 PRIOR ART
FIG. 1 is a perspective view of a conventional portable speaker device.
Figure 2:
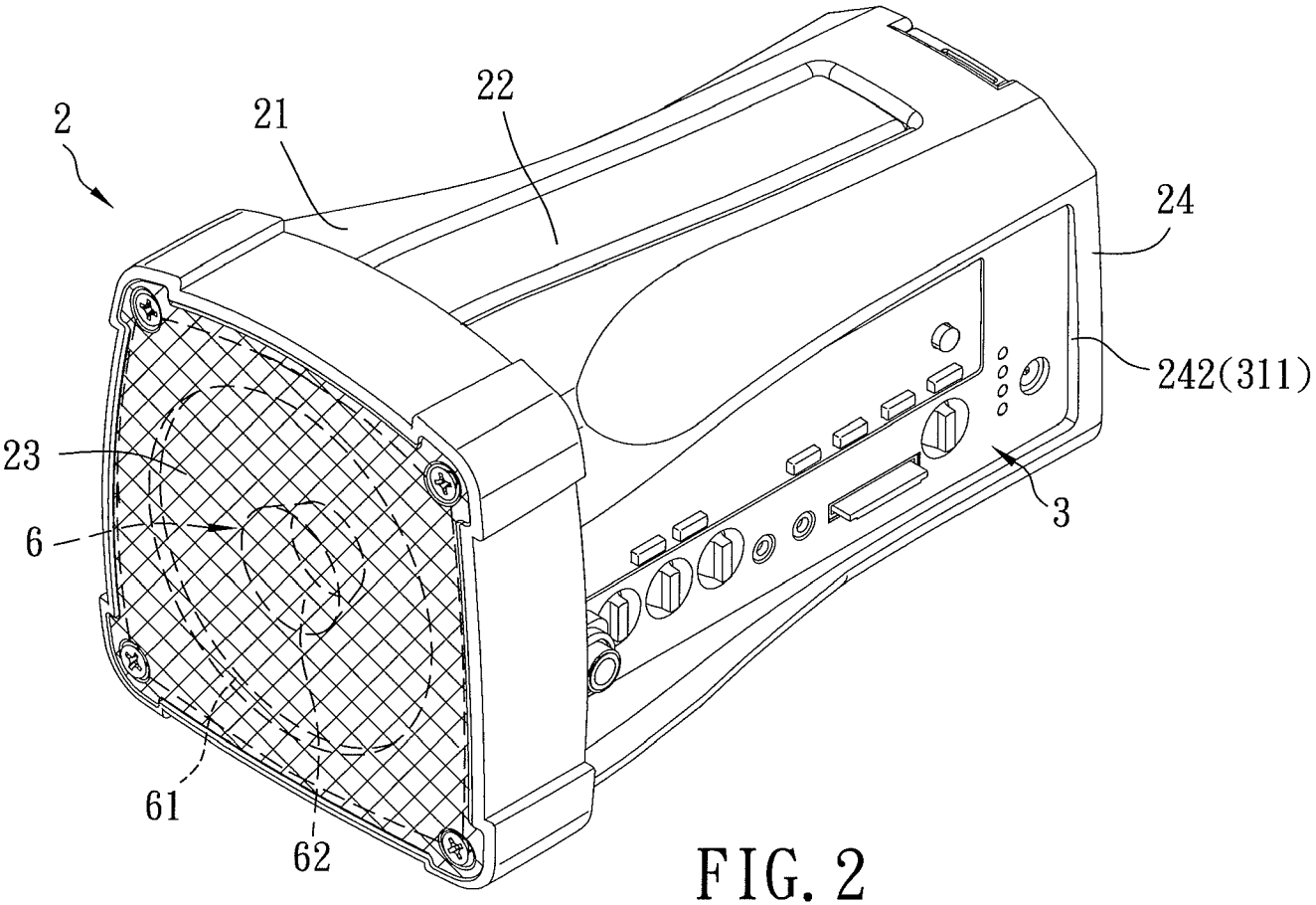
FIG. 2 is a perspective view of the preferred embodiment of an input-panel-equipped portable speaker device according to this invention.
Figure 3:
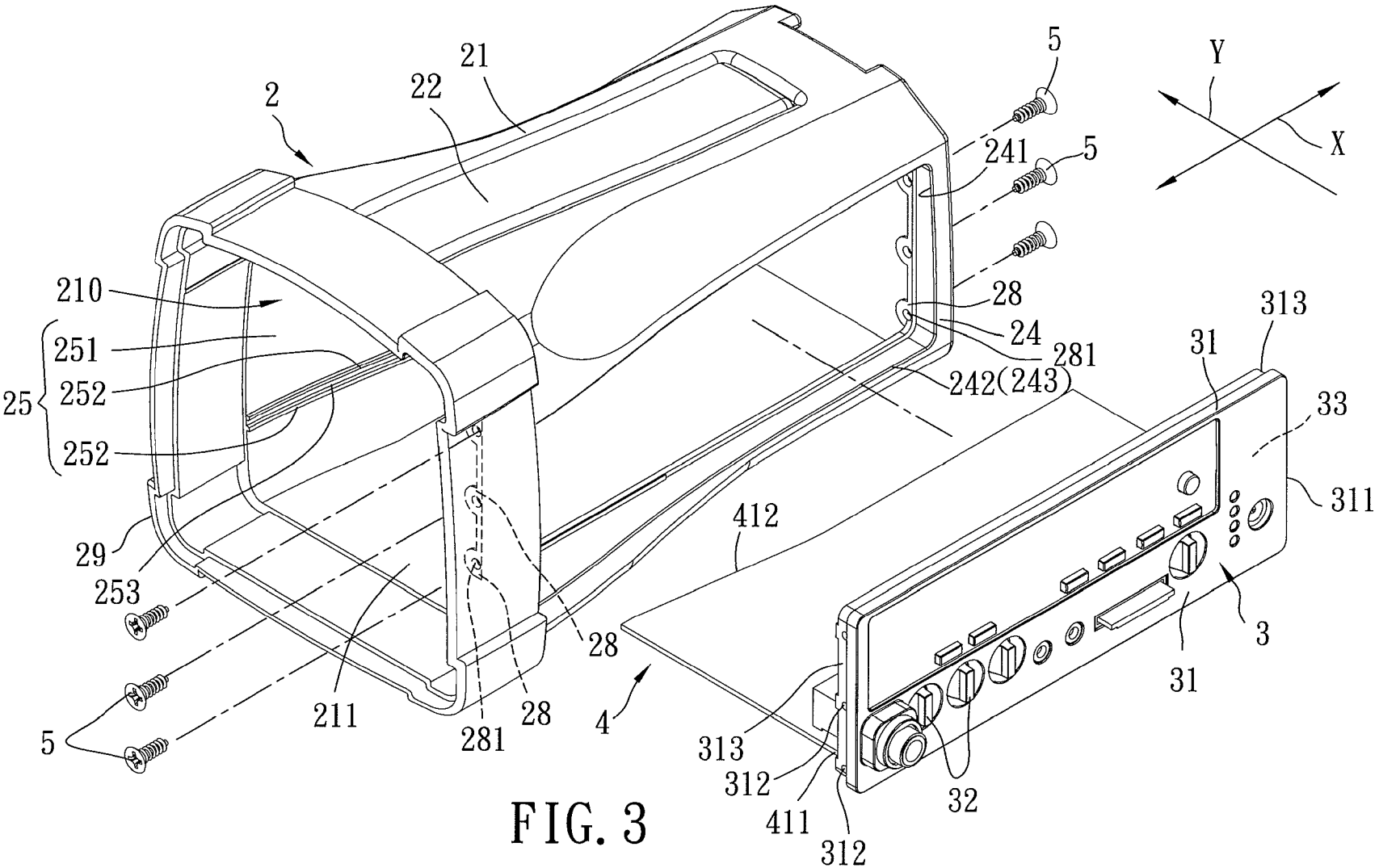
FIG. 3 is an exploded perspective view of the preferred embodiment.
Figure 4:
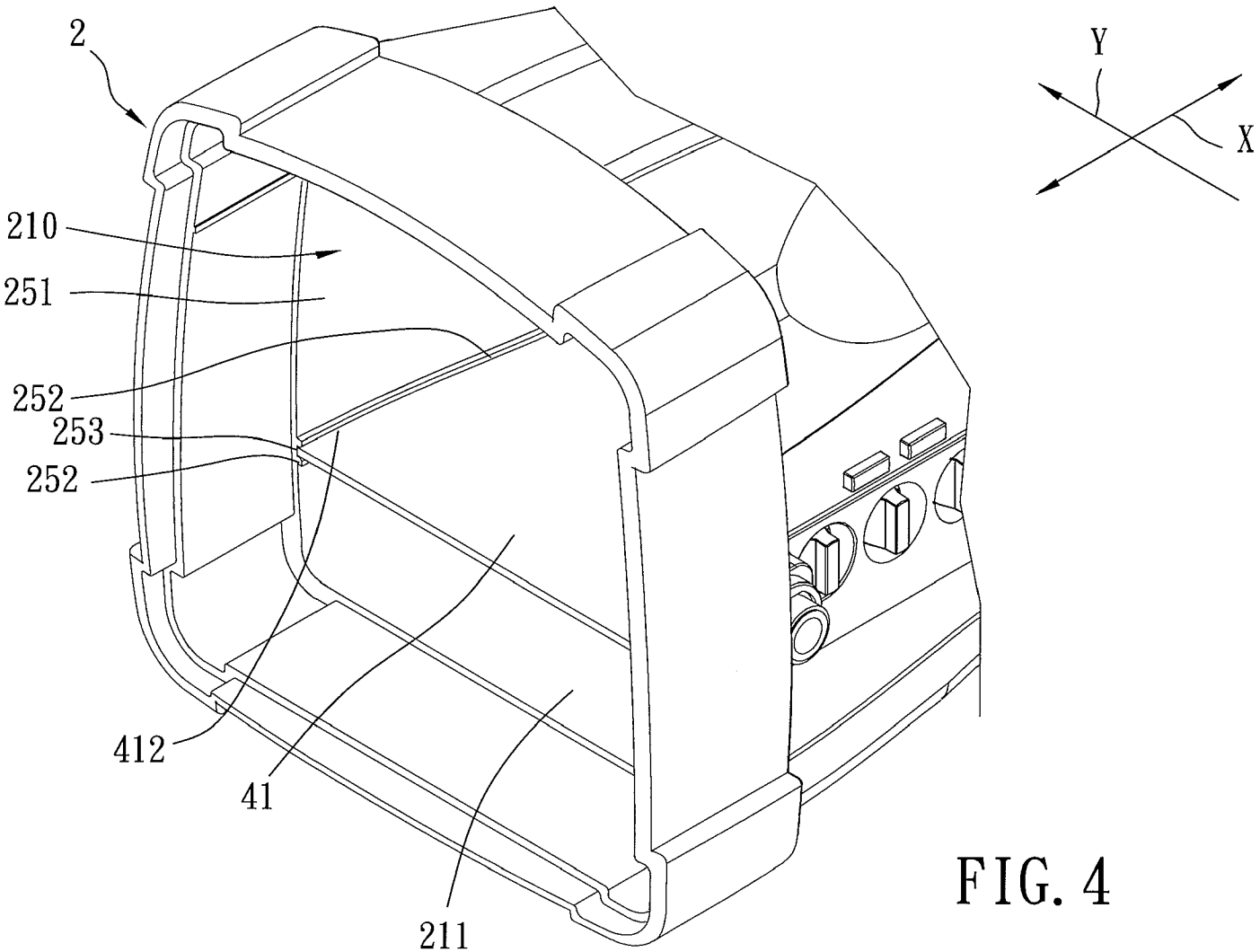
FIG. 4 is a fragmentary perspective view of a front part of the preferred embodiment.

Referring to FIGS. 2 to 4, the preferred embodiment of an input-panel-equipped portable speaker device according to the present invention is shown to comprise a cabinet shell body 2, a speaker driver 6, an input panel 3, an amplifier circuit board 4, and a plurality of front and rear fasteners 5.

The cabinet shell body 2 is configured to enclose an accommodation chamber 210 which extends forwardly and along a centerline in a longitudinal direction (X) to terminate at a front tubular end 29. The cabinet shell body 2 has left and right mounting walls 24, 25 which extend rearwardly from the front tubular end 29, and which are spaced apart from each other by the accommodation chamber 210 in a direction (Y) transverse to the longitudinal direction (X). The left and right mounting walls 24, 25 respectively have left and right inner wall surfaces 241, 251 to define the accommodation chamber 210. The left mounting wall 24 is configured to have an inner peripheral region 242 which defines a fitting opening 243 that extends through the left inner wall surface 241 to communicate with the accommodation chamber 210. Two elongated ribs 252 are mounted on the right inner wall surface 251, are elongated in the longitudinal direction (X), and are spaced apart from each other to define a positioning groove 253 therebetween. The cabinet shell body 2 further has a bottom wall 211 and atop wall 21 which extend from rearwardly from the front tubular end 29 and which are disposed between the left and right mounting walls 24, 25. A handle 22 is pivotably mounted on the top wall 21. Further, front and rear positioning lugs 28 extend from the inner peripheral region 242 in the transverse direction (Y), and respectively have holes 281.

The speaker driver 6 has a poleplate portion 62 and a basket frame portion 61 configured to be fittingly mounted in the front tubular end 29 so as to permit the poleplate portion to extend into the accommodation chamber 210 along the centerline. A cover 23 is mounted to cover the front tubular end 29.

The input panel 3 configured to cover the fitting opening 243, and has an outer major surface 31 on which an input unit 32 is mounted for inputting an audio signal, and an inner major surface 33 which is opposite to the outer major surface 31 in the transverse direction (Y), and which has an outer peripheral region 311. Front and rear fastened frame segments 313 are spaced apart from each other in the longitudinal direction (X), and extend rightwardly from the inner major surface 33. Each of the front and rear fastened frame segments 313 has a plurality of screw holes 312.

The amplifier circuit board 4 has a right board edge 412 which is configured to be fitted in the positioning groove 253, and a left board edge 411 which is mounted on the inner major surface 33.

The front and rear fasteners 5 are in the form of screws, each of which is disposed to extend through the hole 281 in the respective positioning lug 28 and threadedly engage the corresponding screw hole 312.

In assembly, the input panel 3 is firstly connected with the circuit board 4 at the left board edge 411 to have the input unit 32 be electronically connected to an electric unit (not shown) mounted on the circuit board 4. Subsequently, the connected panel 3 and circuit board 4 are brought into the accommodation chamber 210 in the transverse direction from the fitting opening 243 such that, when the right board edge 412 of the circuit board 4 is brought to be fitted in the positioning groove 253, the outer peripheral region 311 is brought to abut against the inner peripheral region 242 through the entire length thereof, and the holes 281 in the front and rear positioning lugs 28 are respectively aligned with the screw holes 312 in the front and rear fastened frame segments 313. At this stage, the panel 3 and the circuit board 4 can be held steadily relative to the cabinet shell body 2. Thus, the screw fasteners 5 can be easily operated to threadedly fasten the front and rear positioning lugs 28 to the front and rear fastened frame segments 313 in the longitudinal direction (X) so as to ensure air-tight engagement between the outer peripheral region 311 and the inner peripheral region 242. Since the screw fasteners 5 are fastened to the front and rear fastened frame segments 313 through the front and rear positioning lugs 28 which are disposed inwardly of the inner and outer peripheral regions 242, 311, and are thus concealed when the input panel 3 covers the fitting opening 243, the speaker device can have a good outer appearance.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. An input-panel-equipped portable speaker device comprising:

a cabinet shell body configured to enclose an accommodation chamber which extends forwardly and along a centerline in a longitudinal direction to terminate at a front tubular end, said cabinet shell body having left and right mounting walls which extend rearwardly from said front tubular end, and which are spaced apart from each other by said accommodation chamber in a direction transverse to the longitudinal direction, said left and right mounting walls respectively having left and right inner wall surfaces to define said accommodation chamber, said left mounting wall being configured to have an inner peripheral region which defines a fitting opening that extends through said left inner wall surface to communicate with said accommodation chamber, and a positioning groove disposed on said right inner wall surface, and extending in the longitudinal direction;

a speaker driver which has a poleplate portion and a basket frame portion configured to be fittingly mounted in said front tubular end so as to permit said poleplate portion to extend into said accommodation chamber along the centerline;

an input panel configured to cover said fitting opening, and having an outer major surface on which an input unit is mounted for inputting an audio signal, and an inner major surface which is opposite to said outer major surface in the transverse direction, and which has an outer peripheral region; and an amplifier circuit board having a right board edge which is configured to be fitted in said positioning groove, and a left board edge which is mounted on said inner major surface such that, when said right board edge is brought to be fitted in said positioning groove, said outer peripheral region is brought to abut against said inner peripheral region through the entire length thereof so as to enable an air-tight engagement therebetween.

2. The speaker device according to claim 1, wherein said input panel has front and rear fastened frame segments which are spaced apart from each other in the longitudinal direction, and which extend rightwardly from said inner major surface;

said cabinet shell body having front and rear positioning lugs which extend from said inner peripheral region in the transverse direction;

said speaker device further comprising front and rear fasteners configured to threadedly fasten said front and rear positioning lugs, respectively, to said front and rear fastened frame segments in the longitudinal direction so as to ensure the air-tight engagement between said outer peripheral region and said inner peripheral region.

3. The speaker device according to claim 1, wherein said cabinet shell body has two elongated ribs mounted on said right inner wall surface, elongated in the longitudinal direction, and spaced apart from each other to define said positioning groove therebetween.

* * * * *